US005963988A

United States Patent [19]

Jackson, Jr.

[11] Patent Number: 5,963,988

[45] **Date of Patent: *Oct. 12, 1999**

[54] HIGH STRETCH COMPOSITE ELASTIC WAISTBAND

[76] Inventor: Clyde E. Jackson, Jr., 28 Perthshire Dr., Peachtree City, Ga. 30269

[ * ] Notice: This patent is subject to a terminal disclaimer.

[21] Appl. No.: 08/932,113

[22] Filed: Sep. 17, 1997

Related U.S. Application Data

[63] Continuation-in-part of application No. 08/840,748, Apr. 16, 1997, Pat. No. 5,787,510

[60] Provisional application No. 60/015,834, Apr. 19, 1996.

[51] Int. Cl.[6] ..... A41D 1/06

[52] U.S. Cl. ..... 2/243.1; 2/221; 2/237; 2/76; 139/422; 66/172 E

[58] Field of Search ..... 2/76, 220, 221, 2/236, 237, 67, 338, 401, 243.1, 240, 311, 312; 66/169 R, 170, 172 E, 202; 87/2; 24/712; 139/421, 422; 112/413–419

[56] References Cited

U.S. PATENT DOCUMENTS

| | | |
|---|---|---|
| Re. 33,586 | 5/1991 | Graff . |
| 162,353 | 4/1875 | Culp . |
| 240,645 | 4/1881 | Bernstein . |
| 735,560 | 8/1903 | Muller . |
| 1,475,653 | 11/1923 | Rosenberg . |
| 1,686,630 | 10/1928 | Loveman . |
| 1,921,271 | 8/1933 | Lubin . |
| 1,941,509 | 1/1934 | Allen . |
| 2,084,938 | 7/1937 | Busch et al. . |
| 2,088,302 | 7/1937 | McKeever . |
| 2,197,188 | 4/1940 | Lilley . |
| 2,392,221 | 1/1946 | Brady . |
| 2,418,582 | 4/1947 | Stumpf . |
| 2,551,044 | 5/1951 | Ottinger et al. . |
| 2,721,331 | 10/1955 | Scheitlin . |
| 2,854,670 | 10/1958 | Naccash . |
| 2,936,603 | 5/1960 | Lewine . |

(List continued on next page.)

FOREIGN PATENT DOCUMENTS

| | | |
|---|---|---|
| 832556 | 9/1938 | France . |
| 1474814 | 2/1967 | France . |
| 1208680 | 1/1966 | Germany . |
| 17330 | 8/1898 | Switzerland . |
| 16195 | of 1893 | United Kingdom . |
| 1306 | of 1914 | United Kingdom . |
| 632522 | 11/1949 | United Kingdom . |
| 1392199 | 4/1975 | United Kingdom . |

OTHER PUBLICATIONS

A page from a medical publication disclosing, and a sample of, an abdominal binder (i.e., bandage) that was on sale in the U.S. before Apr. 1995.

*Primary Examiner*—Gloria Hale
*Attorney, Agent, or Firm*—Kennedy, Davis & Hodge, PC

[57] ABSTRACT

Provided is a high stretch composite elastic waistband that includes a relatively large ratio of drawcord to the relaxed length of an elastic web. The drawcord is fixed to the elastic web in such a way that the drawcord is allowed to move relative to the elastic web to form multiple gathers or drawcord protrusions, such as protruding loops or partial loops, as the elastic web returns to a relaxed size. The drawcord protrusions extend relative to the elastic web. The composite elastic waistband is constructed so that at least a section of the drawcord is capable of being pulled away from the elastic web so that the gathers or protrusions are diminished. Then the elastic web is capable of being stretched and released so that the elastic web contracts and cooperates with the drawcord to form the plurality of gathers or drawcord protrusions. This accumulates excess portions of the drawcord. The drawcord is movably attached to the elastic band by connecting stitches so that the drawcord extends in the longitudinal direction. Spaces are defined between neighboring connecting stitches so that a plurality of open spaces is defined. The protrusions defined by the drawcord extend through the open spaces defined between the stitches.

20 Claims, 4 Drawing Sheets

U.S. PATENT DOCUMENTS

| | | |
|---|---|---|
| 2,998,829 | 9/1961 | Horowitz . |
| 3,167,941 | 2/1965 | Rab . |
| 3,172,430 | 3/1965 | Weidhaas . |
| 3,236,070 | 2/1966 | Clayton, Jr. . |
| 3,887,968 | 6/1975 | Lynam . |
| 4,714,096 | 12/1987 | Guay . |
| 5,040,244 | 8/1991 | Tubbs . |
| 5,186,779 | 2/1993 | Tubbs . |
| 5,375,266 | 12/1994 | Crisco . |
| 5,452,591 | 9/1995 | King . |

HIGH STRETCH COMPOSITE ELASTIC WAISTBAND

RELATED APPLICATIONS

This application is a continuation-in-part of U.S. patent application Ser. No. 08/840,748, filed Apr. 16, 1997, now U.S. Pat. No. 5,787,510 which claims the benefit of U.S. Provisional Application Serial No. 60/015,834, filed Apr. 19, 1996.

BACKGROUND OF THE INVENTION

Elastic waistbands and drawcords are frequently used in athletic apparel such as gym shorts, sweat pants and swim trunks. The elastic waistband provides a fairly snug fit for wearers of different sizes. The drawcord may be pulled snug and tied into a bow to obtain a tighter and more secure fit than is provided by the elastic waistband alone. In order to have enough drawcord to tie a satisfactory bow, the drawcord must be at least several inches longer than the circumference of the elastic waistband when the waistband is stretched to fit around the wearer's waist. Obviously, this requires the length of the drawcord to be considerably greater than the length of the elastic waistband when the waistband is in a relaxed or unstretched condition.

In many garments of this type, the elastic waistband and drawcord are incorporated into the garment in separate steps. The waistband is first sewn into a loop, which is then stretched and placed on a machine that holds the garment. The stretched waistband is then sewn to the garment using sewn seams that run around the circumference of an opening in the garment. A channel is then formed between two of the seams, and the drawcord is inserted into the channel by inserting a flexible wire with a hook into the channel and pulling the drawcord through the channel. This method allows the manufacturer to include a drawcord having any desired length. However, this method is labor intensive and significantly increases production costs.

Several prior art products attempt to simplify the manufacturing process by providing composite waistbands in which the drawcord is combined with the elastic band before the elastic band is sewn into the garment. In many manufacturing plants, the composite waistband is sewn into a loop that is stretched and placed on a machine that holds the garment. After the garment and the composite waistband are sewn together, the garment is removed from the machine. This allows the elastic to contract and return to an unstretched state, which causes the waist of the garment to bunch up.

One type of composite waistband is described in U.S. Patent No. Re. 33,586, entitled "Elastic with Embedded Pull Cord." This patent describes a woven, knitted or braided elastic band in which a pull cord is "embedded." This composite waistband is sewn in a garment as described above. A portion of the drawcord is then pulled through the elastic band and through a slit in the waist of the garment, where the ends of the drawcord are available to be tied into a bow.

Another type of composite waistband is described in U.S. Pat. No. 5,375,266, entitled "Composite Drawcord/Elastic Waistband" and U.S. Pat. No. 5,452,591, entitled "Knitted Band with Integrated Drawcord and Method of Fabricating Same." Those patents disclose a drawcord that is secured to one side of an elastic band by a yarn that lays over the drawcord to define a tunnel that holds the drawcord to the surface of the elastic band.

Each of the above-discussed prior art composite waistbands simplifies the process of sewing an elastic waistband and drawcord in a garment. However, the amount of drawcord that can be incorporated into those prior art composite waistbands and the degree to which those prior art composite waistbands can be stretched are limited. The above-discussed prior art composite waistbands are typically cut from a "continuous" elongate strip of composite waistband. The elongate strip of composite waistband is constructed so that when the elongate strip is in a stretched or unstretched state, all of the drawcord is maintained generally parallel to the elastic web of the composite waistband. That is, there is no place for substantial amounts of excess drawcord to reside when the composite waistband is in a relaxed or unstretched configuration. This severely limits the length of the drawcord. When the length of the drawcord is limited, the degree to which the composite waistband can be stretched is limited. If the elastic web of a composite waistband is stretched to a length longer than the drawcord, the ends of the drawcord are lost in the elastic web and the composite waistband cannot be used properly. Also, there is no value in increasing the stretchability of the elastic web of a composite waistband when the degree to which the composite waistband can be stretched is limited by the length of the drawcord.

Because the drawcord remains generally parallel to the elastic band in the above-discussed prior art composite waistbands, the length of the drawcord is generally limited to that which can be compressed coaxially (i.e., along the cord's longitudinal axis) to the same length as the elastic band in a relaxed state. Therefore, in most prior art composite waistbands, drawcords that can be readily coaxially compressed are employed in an effort to increase the effective length of the drawcords. However, at least some of such cords can shrink and lose their stretchability when laundered. Further, sometimes the use of a flat, tape-like drawcord (e.g., ribbon) in a composite waistband is desirable, but the axial compressibility of most flat drawcords is very limited.

Another type of composite waistband is described in U.S. Pat. No. 5,040,244, entitled "Elastic Waistband with Releasably Secured Drawstring" and U.S. Pat. No. 5,186,779, entitled "Method of Making an Elastic Waistband with Releasably Secured Drawstring." These patents describe a drawcord that is affixed to a previously fabricated elastic band by an adhesive. The adhesive holds the drawcord in place on one surface of the elastic band while the band is sewn in a garment. After the garment is sewn, the drawcord is released from the elastic band by pulling on the drawcord. A problem with this approach is that careful handling is required to prevent the drawcord from being detached from the elastic band prior to being sewn in the garment. If the drawcord becomes detached prematurely, the product is useless. Also, having to release numerous drawcords from their respective elastic bands is labor intensive.

Therefore, there is a need in the art for a high stretch composite elastic waistband that includes a relatively large ratio of drawcord to the relaxed length of the elastic band.

SUMMARY OF THE INVENTION

The present invention provides a high stretch composite elastic waistband that is capable of including a relatively large ratio of drawcord to the relaxed length of an elastic web of the waistband. The present invention accomplishes this by affixing the drawcord to the elastic web in such a way that, as the elastic web returns to its relaxed size, the elastic web accumulates the drawcord. The elastic web accumulates the drawcord by causing the drawcord to move substantially relative to the elastic web so that the drawcord defines multiple gathers. The gathers preferably protrude relative to the elastic web to define drawcord protrusions.

The composite elastic waistband is constructed so that at least a section of the drawcord is capable of being pulled away from the elastic web so that the gathers are diminished or, more particularly, the protrusions are at least partially flattened. Then the elastic web is capable of being stretched and released so that the elastic web contracts and cooperates with the drawcord to accumulate the drawcord by causing the drawcord to move substantially relative to the elastic web so that the drawcord defines the plurality of gathers or drawcord protrusions.

The drawcord is movably attached to the elastic web by multiple connector members, such as connecting stitches or the like, so that the drawcord extends in the longitudinal direction. Spaces are defined between neighboring connecting stitches. Individual protrusions defined by the drawcord extend through individual spaces defined between the stitches.

Even more particularly, the composite elastic waistband includes a pair of elastic webs, each of which includes a longitudinally extending finished edge. A longitudinally extending space is defined between the finished edges. The connecting stitches extend laterally across the longitudinally extending space and join the edges to define a composite elastic band. The drawcord is movably held by the connecting stitches so that the drawcord protrusions protrude from the longitudinally extending space and between the stitches.

Still more particularly, a cross-section of the drawcord taken perpendicular to its length can be somewhat circular, or a cross-section of the drawcord taken perpendicular to its length can be generally linear. Additionally, the composite waistband can be cut into lengths, formed into loops and then incorporated into garments, as should be understood by those skilled in the art.

It is an object of the present invention to provide a high stretch composite elastic waistband with a high ratio of drawcord to elastic web.

It is another object of the present invention to provide a high stretch composite elastic waistband that contains sufficient drawcord so that the stretchability of the waistband is not restricted by the drawcord.

It is another object of the present invention to provide a high stretch composite elastic waistband that may be easily loaded onto automatic or manual machines that attach composite elastic waistbands to garments.

It is another object of the present invention to provide a high stretch composite elastic waistband that includes an ample amount of drawcord for tying a large bow.

It is another object of the present invention to provide a high stretch composite elastic waistband that is constructed in a manner that allows the stretchability of the elastic web to be maximized and utilized.

These and other objects, features and advantages of the present invention may be more clearly understood and appreciated from a review of the following detailed description of the invention and by reference to the appended drawings.

DETAILED DESCRIPTION OF EXEMPLARY EMBODIMENTS

The present invention will now be described with reference to the drawings, in which like numerals represent like elements throughout the several views.

Figure 1:
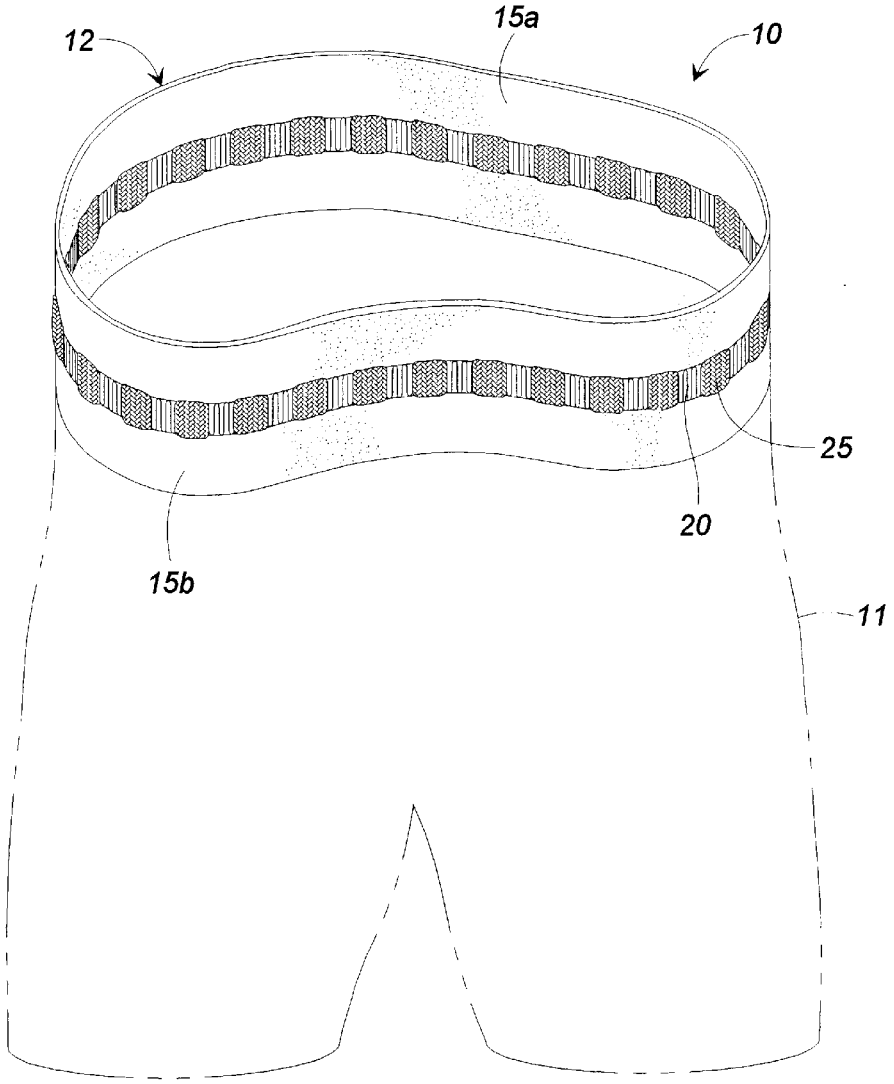
FIG. 1 illustrates the high stretch composite elastic waistband constructed in accordance with a first exemplary embodiment of the present invention, wherein a garment is shown in broken-lines.
Figure 2:
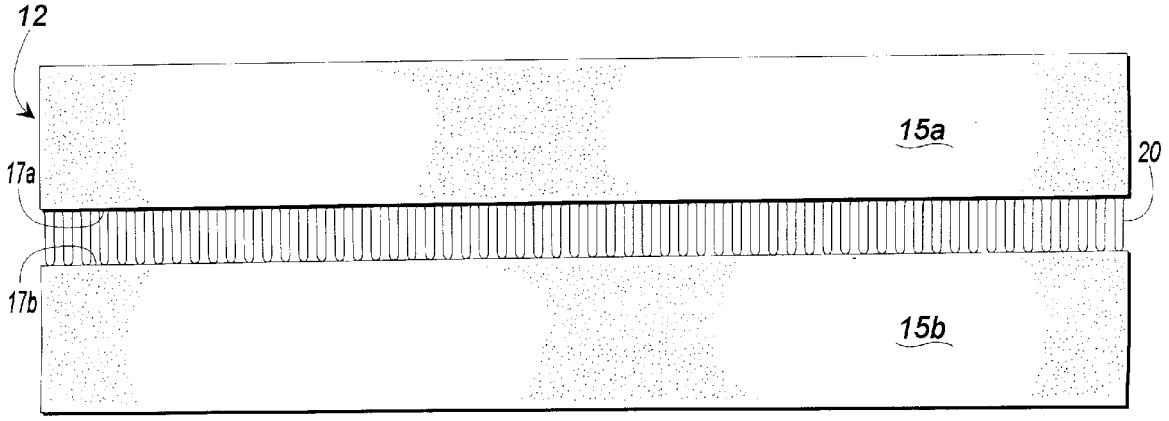
FIG. 2 illustrates a section of the joined elastic webs that form the composite elastic band of the high stretch composite elastic waistband of FIG. 1.
Figure 5:
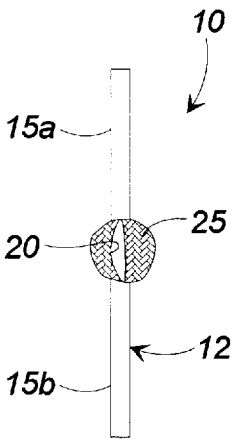
FIG. 5 is a cross-sectional view of the high stretch composite elastic waistband taken along the line 5—5 of FIG. 4.
Figure 3:
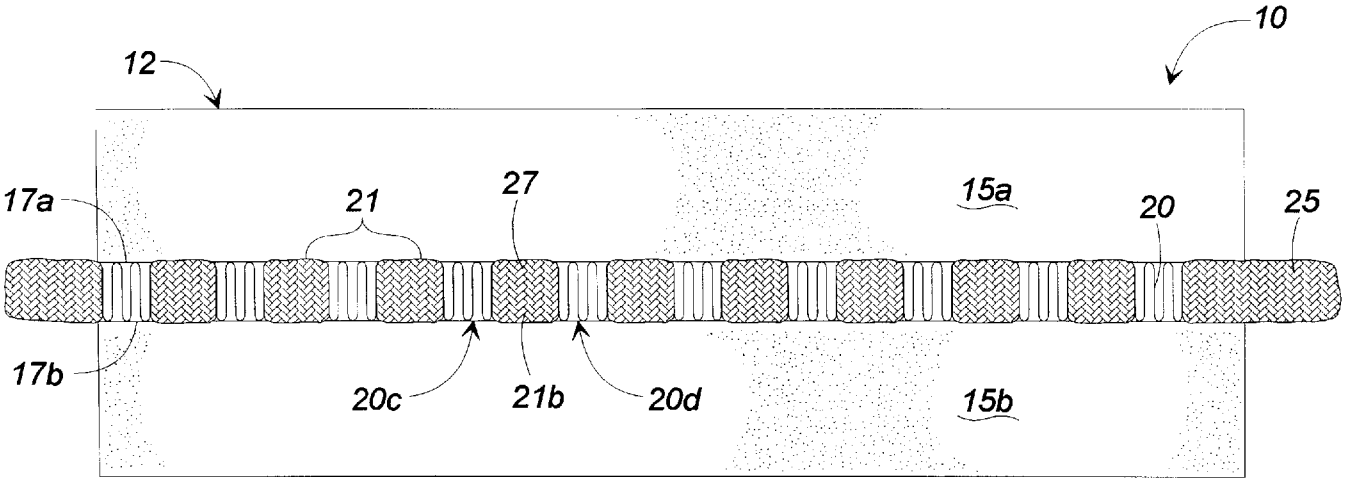
FIG. 3 illustrates a section of the high stretch composite elastic waistband of FIG. 1, wherein the composite elastic band is relaxed and has accumulated excess portions of the drawcord.
Figure 4:
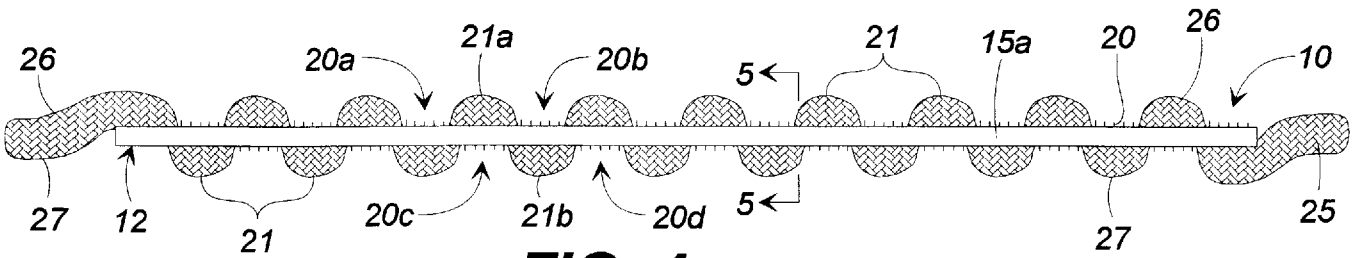
FIG. 4 is a top edge view of the high stretch composite elastic waistband of FIG. 3.
Figure 7:
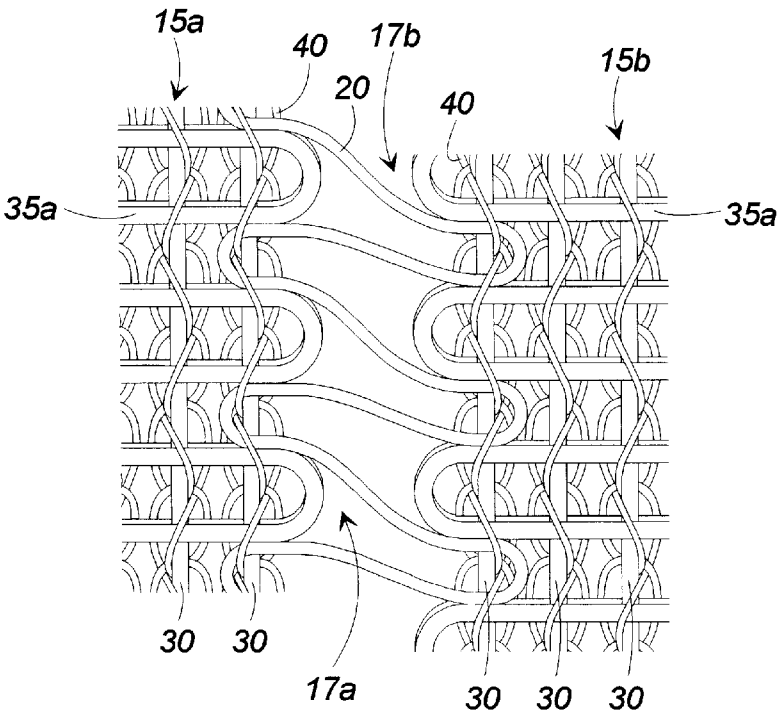
FIG. 7 is a magnified view illustrating two knitted elastic webs joined by a connecting stitch.
Figure 6:
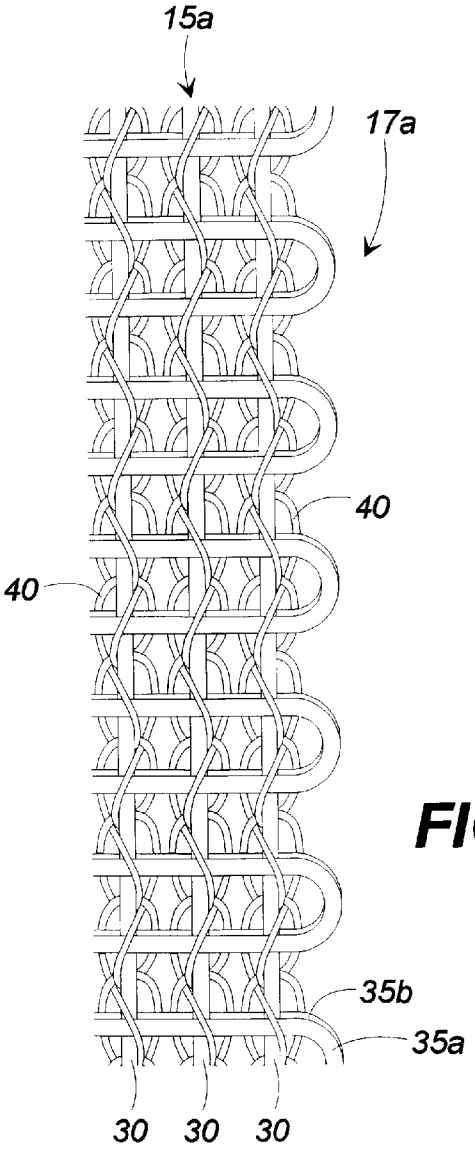
FIG. 6 is a magnified, partial front view of a stretched knitted elastic web.

A high stretch composite elastic waistband constructed in accordance with a first exemplary embodiment of the present invention provides a composite waistband that incorporates a relatively large amount of drawcord. FIG. 1 shows the composite waistband 10 after it has been sewn into a loop and attached to an exemplary pair of pants 11, which are depicted by broken lines. The pair of pants 11 are constructed from a piece of cloth that has a perimeter, which defines an opening, to which the composite waistband 10 is attached. FIGS. 3–5 illustrate a section of the composite waistband 10 in a generally planar configuration. FIGS. 2 and 6–7 illustrate portions of the composite waistband 10 in generally planar configurations, without showing the drawcord 25.

The first exemplary high stretch composite waistband 10 includes two elastic webs 15*a*, 15*b* that are held together by a connecting stitch 20. The connecting stitch 20 includes multiple individual stitches that join the elastic webs 15*a*, 15*b* to define a composite elastic band 12. In FIGS. 1 and 3–5, the elastic webs 15*a*, 15*b*, and therefore the composite elastic band 12, are relaxed (i.e., unstretched). The drawcord 25 protrudes at predetermined intervals through openings or spaces defined between stitches of the connecting stitch 20. The protruding of the drawcord 25 through openings defined by the connecting stitch 20 allows a large amount of drawcord 25 to be connected to the relaxed elastic webs 15*a*, 15*b*. The connecting stitch 20 preferably includes or is defined by two separate and continuous pieces of connector yarn 50, 52 (FIG. 7) or similar material. During manufacture, the two yarns 50, 52 that form the connecting stitch 20 are preferably stitched on opposite sides of the drawcord 25 and define "blanks" or openings through which the drawcord 25 can protrude. Further, the connecting stitch 20 loosely holds the drawcord 25 to the elastic webs 15*a*, 15*b*.

More particularly, the high ratio of drawcord 25 to composite elastic band 12 is provided in the present invention because in response to the release of the composite elastic band 12 from a longitudinally stretched configuration, the drawcord 25 moves substantially relative to the composite elastic band to form multiple gathers. In accordance with the exemplary embodiments of the present invention, the gathers protrude between groups of connecting stitches 20 to define drawcord protrusions 21, such as protruding loops or partial loops. The drawcord protrusions 21 extend outward relative to the composite elastic band 12. This protruding or looping is illustrated in FIG. 4, where the composite elastic band 12 is relaxed and has accumulated or gathered excess portions of the drawcord 25. The composite elastic band 12 accumulates excess portions of the drawcord 25 by cooperating with the drawcord 25 to form the plurality of drawcord protrusions 21 that are arranged sequentially along and protrude from the opposite sides of the composite elastic band 12. Only a few of the protrusions 21 are specifically pointed out in FIG. 4 in an effort to clarify the view. Two of the protrusions 21*a*, 21*b* are proximate to groups of individual connecting stitches 20*a*, 20*b*, 20*c*, 20*d*.

As depicted in FIG. 4, the front connector yarn 50 defines all of the individual stitches of the connecting stitch 20 that are proximate to the front sides 54 of the elastic webs 15*a*, 15*b*, and the back connector yarn 52 defines all of the individual stitches of the connecting stitch 20 that are proximate to the back sides 56 of the elastic webs 15*a*, 15*b*. For example, the groups of individual connecting stitches 20*a*, 20*b* are defined by the back connector yarn 52 of the connecting stitch 20, and the groups of individual connecting stitches 20*c*, 20*d* are defined by the front connector yarn 50 of the connecting stitch 20. Each of the connector yarns 50, 52 alternately defines groups of individual stitches and "blanks" or openings. The protrusions 21 protrude through those openings. For example, the protrusion 21*a* protrudes through an opening defined between the groups of individual connecting stitches 20*a*, 20*b*, and the protrusion 21*b* protrudes through an opening defined between the groups of individual connecting stitches 20*c*, 20*d*.

The connector yarns 50, 52 attach a longitudinally extending edge 17*a* of the elastic web 15*a* and a longitudinally extending edge 17*b* of the elastic web 15*b* to each other so that the edges 17*a*, 17*b* are separated by a distance that is approximately equal to the diameter of the drawcord 25. Therefore, an elongate space is defined between the longitudinally extending edge 17*a* of the elastic web 15*a* and the longitudinally extending edge 17*b* of the elastic web 15*b*. The individual stitches of the connecting stitch 20 are connected between the edges 17*a*, 17*b* and extend across the elongate space defined between the edges 17*a*, 17*b*. The connecting stitch 20 is loose enough to allow the drawcord 25 to move and oscillate through the openings defined between stitches of the connecting stitch 20 and form the protrusions 21 (FIG. 4) when the composite elastic band 12 is allowed to contract from a stretched state. The connecting stitch 20 is also tight enough to hold the drawcord 25 in place when the composite elastic band 12 is relaxed and the drawcord 25 is not being pulled by a user.

More particularly, the longitudinally extending edge 17*a* of the elastic web 15*a* is generally parallel to and spaced apart from the longitudinally extending edge 17*b* of the elastic web 15*b*. Each of the edges 17*a*, 17*b*, examples of which are depicted in the magnified views of FIGS. 6 and 7, is preferably finished (e.g., crisscrossed, squared or rounded) such that they will not unravel or become unknitted. While the finished edges 17*a*, 17*b* are connected to each other by the connecting stitch 20, the connector yarns 50, 52 of the connecting stitch 20 are preferably not part of either of the elastic webs 15*a*, 15*b*. Individual segments (e.g., members) of the connector yarns 50, 52 that extend between the finished edges 17*a*, 17*b* are preferably spaced from one another and are not intertwined or meshed with one another. The arrangement of the connector yarns 50, 52 is preferably different from the arrangement of each of the parts of the elastic webs 15*a*, 15*b*.

The drawcord 25 is located between the finished edges 17*a*, 17*b* such that the drawcord 25 is not embedded or intermeshed in either of the elastic webs 15*a*, 15*b*. The connecting stitch 20 is loose enough to allow the drawcord 25 to move relative to the composite elastic band 12 when such movement is initiated by a user of the composite waistband 10 or contraction of the composite elastic band 12, but tight enough to hold the drawcord 25 to the composite elastic band 12 when the elastic webs 15*a*, 15*b* are relaxed and the drawcord 25 is not pulled by a user.

Referring primarily to FIG. 4, when the composite elastic band 12 is stretched longitudinally and then released, the composite waistband 10 functions so that the drawcord 25 accumulates excess portions of the drawcord 25 by automatically forming the gathers or protrusions 21. The drawcord 25 includes a back side 26 and a front side 27 (also see corresponding sides 26', 27' of the drawcord 25' of the exemplary embodiment depicted in FIGS. 8 and 9). As depicted in FIG. 4, for a representative first longitudinal segment of the drawcord 25 that defines the upward extending protrusion 21*a*, the group of individual connecting stitches 20*c* contacts the front side 27 of the drawcord 25, and the connecting stitch 20 generally does not contact the back side 26 of the drawcord 25. That is, the protrusion 21*a* extends or protrudes into the opening or "blank" defined between the groups of individual connecting stitches 20*a*, 20*b*. For a representative second longitudinal segment of the drawcord 25 that is contiguous to the first segment of the drawcord 25 and defines the downward extending protrusion 21*b*, the group of individual connecting stitches 20*b* contacts the back side 26 of the drawcord 25, and the connecting stitch 20 generally does not contact the front side 27 of the drawcord 25. That is, the protrusion 21*b* extends or protrudes into the opening or "blank" that is defined between the groups of individual connecting stitches 20*c*, 20*d*. These patterns are repeated for the entire length of the composite waistband 10.

As depicted in FIG. 4, the composite elastic band 12 is relaxed. Further, the composite elastic band 12 has accumulated a length of drawcord 25 that is greater than the length of the relaxed composite elastic band 12. When the composite waistband 10 is configured as depicted in FIG. 4, the ends of the drawcord 25 can be grasped and pulled to pull portions of the drawcord 25 away from the composite elastic band 12 so that the ends of the drawcord 25 are available to be tied into a bow. When portions of the drawcord 25 are pulled away from the composite waistband 10, the gathers are diminished or, more particularly, the protrusions 21 are flattened.

The amount of accumulated drawcord 25 can be illustrated by considering an embodiment similar to the embodiment depicted in FIG. 4. For example, for a piece of composite waistband 10 in which the composite elastic band 12 is relaxed and has accumulated the drawcord 25 to define nine drawcord protrusions 21 on each side of the composite elastic band 12 (for a total of eighteen protrusions 21; refer to FIG. 4), the length of the unstretched composite elastic band 12 is approximately 2.25 inches, and the length of a straight line between the opposite ends of the drawcord 25 is approximately 3 inches. Therefore, 0.75 inches of drawcord 25 extend beyond the ends of the composite elastic band 12. After the ends of the drawcord 25 are grasped and pulled to pull portions of the drawcord 25 away from the composite elastic band 12, the unstretched length of the drawcord 25 is approximately 5.75 inches. Therefore, a total of 5 inches of drawcord 12 is accumulated in the 2.25 inch length of the composite waistband 10.

The degree to which the protrusions 21 defined by the drawcord 25 protrude from the composite elastic band 12, and therefore the ratio of the drawcord 25 to the composite elastic band 12, may be altered during the manufacture of the composite waistband 10. For example, as depicted in FIG. 4, the protrusions 21 extend from the composite elastic band 12 to a limited degree. In contrast, in accordance with an exemplary embodiment of the present invention illustrated in FIGS. 8–10 (and other embodiments of the present invention), the protrusions 21' (FIGS. 8 and 9) protrude further from the composite elastic band 12 than depicted in FIG. 4. As depicted in FIG. 9, for an individual protrusion 21' of the second exemplary embodiment, neither the back side 26' nor the front side 27' of the drawcord 25' substantially contacts the connecting stitch 20.

As discussed above, when the composite waistband 10 is configured as depicted in FIG. 4, the ends of the drawcord 25 can be grasped and pulled to release portions of the drawcord 25 from the composite elastic band 12. When the portions of the drawcord 25 are drawn from the composite elastic band 12, the gathers or protrusions 21 are flattened such that they are no longer defined (for example, see FIG. 10). The composite elastic band 12 can then be stretched longitudinally and released. The composite waistband 10 is constructed so that when the composite elastic band 12 is longitudinally stretched and released, the composite elastic band 12 contracts and cooperates with the drawcord 10 so that the drawcord 10 is accumulated by the composite elastic band 12 such that the drawcord defines the gathers or protrusions 21.

In the first exemplary high stretch composite waistband 10, the elastic webs 15*a*, 15*b* preferably embody a knitted elastic construction. For example, each web 15*a*, 15*b* may include a composition of polyester and elastomeric fibers that are knitted together in a manner known to those skilled in the art. The elastomeric fibers extend in the longitudinal direction of the webs 15*a*, 15*b* and allow the composite elastic band 12 to be stretched lengthwise. The composite elastic band 12 may be stretchable from approximately 200 to 250% of its relaxed length (percentage being calculated by dividing the stretched length by the relaxed length, and then multiplying by 100). Those skilled in the art will appreciate that although the elastic webs 15*a*, 15*b* are preferably knitted, they may also be formed using other techniques, such as weaving or braiding. Alternatively, the elastic webs 15*a*, 15*b* can be prefabricated elastic tapes. Those skilled in the art will also appreciate that the relative widths of the elastic webs 15*a*, 15*b* may be varied to position the drawcord 25 closer to the top or bottom edge of the composite elastic band 12.

Turning now to FIGS. 2 and 6–7, the process of manufacturing a preferred high stretch composite waistband 10 will be described. Those skilled in the art will appreciate that the manufacture of a preferred high stretch composite waistband 10 employs conventional knitting techniques associated with warp knit elastics, and adds the connecting stitch 20 and drawcord 25 during the knitting process.

FIG. 6 is a magnified view of a portion of the knitted elastic web 15*a* in a stretched configuration. The elastic web 15*a* includes a plurality of elastomeric fibers or elastomers 30 that extend along the length of the elastic web 15*a*. The elastomers 30 are sandwiched between two filler yarns 35*a*, 35*b* that oscillate back and forth perpendicular to the elastomers 30. The front filler yarn 35*a* is located on the front side of the elastomers 30. The back filler yarn 35*b* is located on the back side of the elastomers 30. The elastomers 30 and filler yarns 35*a*, 35*b* are held together by a plurality of warp yarns 40. Each warp yarn 40 runs generally parallel to an elastomer 30. The warp yarns 40 hold the elastomers 30 and filler yarns 35*a*, 35*b* together by forming a crochet knitting stitch at each intersection of the elastomers 30 and filler yarns 35*a*, 35*b*. Those skilled in the art will understand that the filler yarns 35*a*, 35*b* are also referred to as picks or courses.

Knitted elastics are acceptably manufactured on flat bed crochet knitting machines, such as those manufactured by Muller of Switzerland and Comez S.P.A. of Italy. These machines come with needle beds of varying widths. It is common to have 400 or more needles in a needle bed. There is one warp yarn 40 and one elastomer 30 for each needle. Common flat bed crochet knitting machines are 14 gauge and 20 gauge machines.

To knit a typical warp knit elastic web 15, the machine is set up by threading a select number of elastomer yarns 30 through eyelets in a bar positioned over the needle bed. The elastomers 30 correspond to, and are aligned with, the knitting needles. The correct number of elastomer yarns 30 is threaded and spaced across the needle bed to create the correct width for each elastic web and to leave space between the elastic webs 15*a*, 15*b*. The width of the elastic web 15*a* is determined by the number of elastomers 30 in the elastic web 15*a* and the spacing between the needles. This allows a number of webs to be knitted simultaneously and makes full use of the needle bed.

The elastomer yarns 30 are fed into the needle bed from the top and extend vertically. The elastomers 30 are under tension controlled by sets of rollers. The needles are oriented horizontally. There is a warp yarn 40 for each needle that will be used in the knitting process.

The filler yarns 35*a*, 35*b* are fed through tubes that are located above the needle bed. There are two filler yarn tubes (front and rear) for each elastic web 15*a*, 15*b* that is being manufactured on the machine. These tubes oscillate back and forth from edge to edge of each elastic web during the knitting process to deliver the filler yarns 35*a*, 35*b* that are stitched to the elastomers 30.

For each elastic web 15*a*, 15*b*, as the filler yarns 35*a*, 35*b* are placed along the front and back of the elongated elastomers 30, crochet stitches are formed with the warp yarns 40 to hold the elastic web together. The elastic webs 15*a*, 15*b* are formed as they pass through the needle bed. Each crochet stitch is formed as the rear needle bed oscillates while the knitting needles move from back to front between the elongated elastomers 30. This action is synchronized to allow the knitting needles to hook and pull the warp yarn 40 to the opposite side of each elastomer. As this is happening, the warp yarn 40 slides up the shank of the needle and forms a loop. The needles then retract again and pull the warp yarn 40 back through the loop that was just formed. This process results in the formation of crochet stitches that are pulled tight and stitch the front and back filler yarns 35*a*, 35*b* to the elastomers 30. As the knitting is completed, the elastomers 30 are released from tension. Additional information regarding the knitting process is included in U.S. Pat. No. 5,452,591, entitled "Knitted Band with Integrated Drawcord and Method of Fabricating Same," the disclosure of which is incorporated herein by reference.

FIG. 7 is a schematic, magnified partial view of two stretched knitted elastic webs 15*a*, 15*b* with a connecting stitch 20 running back and forth to join them together. The two separate connector yarns 50, 52 of the connecting stitch 20 can be characterized as a front connector yarn 50 and a back connector yarn 52. The connector yarns 50, 52 are preferably constructed of a durable material such as a synthetic fiber sold by E.I. du Pont de Nemours and Company under the trademark LYCRA. The front connector yarn 50 and the back connector yarn 52 are schematically depicted in FIG. 7, which is a front view of the webs 15*a*, 15*b*. The front connector yarn 50 is depicted in the form of a single solid line, and the back connector yarn 52 is depicted in the form of a broken line in an effort to clarify the view. Portions of the back connector yarn 52 are hidden from view in FIG. 7.

As depicted in FIG. 7, the front connector yarn 50 is connected proximate to the front sides 54 (FIG. 4) of the elastic webs 15*a*, 15*b* by the same crochet stitches that stitch the filler yarns 35*a*, 35*b* to the elastomers 30 that are located along the edges 17*a*, 17*b* of the elastic webs. As seen in FIG. 7, the front connector yarn 50 alternately oscillates between the edges 17*a*, 17*b*, which defines groups of individual connecting stitches (e.g., groups of individual connecting stitches 20*c*, 20*d*), and extends longitudinally with the edge 17*b*, which defines "blank" spaces or openings through which the drawcord 25 (FIGS. 1 and 3–5) can protrude.

The back connector yarn 52 is connected proximate to the back sides 56 (FIG. 4) of the elastic webs 15*a*, 15*b* in the same general manner that the front connector yarn 50 is connected to the elastic webs 15*a*, 15*b*. The back connector yarn 52 oscillates between the edges 17*a*, 17*b* to define groups of individual connecting stitches (e.g., groups of individual connecting stitches 20*a*, 20*b*). When the back connector yarn 52 is not forming groups of individual connecting stitches, the back connector yarn 52 extends longitudinally with the edge 17*a* to define "blank" spaces or openings. The "blank" spaces or openings and the groups of individual connecting stitches defined by the connector yarns 50, 52 are arranged in an alternating pattern so that for each "blank" space or opening defined on one side of the composite elastic band 12, a group of individual connecting stitches is defined on the opposite side of the composite elastic band 12. Much of the back connector yarn 52, such as the longitudinally extending portions of the back connector yarn 52, is hidden from view in FIG. 7.

The process of manufacturing the preferred high stretch composite waistband 10 begins by setting up a knitting machine to produce the correct number of elastic webs with appropriate space between them. The elastic webs 15*a*, 15*b* that will be joined together by a connecting stitch 20 are separated from each other by a distance that is approximately equal to the diameter of the drawcord 25 that will be used.

Each of the two connector yarns 50, 52 (FIG. 7) that form the connecting stitch 20 is fed through a separate tube that is positioned above the needle bed. As the elastic webs 15*a*, 15*b* are being knitted in the manner described above, these tubes feed the connector yarns 50, 52 in a manner that results in the alternating "blank" spaces and groups of individual connecting stitches discussed above. At the same time, a drawcord 25 (which may be braided, woven, knitted, elastic or nonelastic) is fed into the knitting machine in the same direction as the warp yarns 40. The drawcord 25 is fed from a stationary tube that is located above the needle bed and between the two webs 15*a*, 15*b*. The groups of individual connecting stitches defined by the front connector yarn 50 (FIG. 7) extend over one side of the drawcord 25 while the groups of individual connecting stitches defined by the back connector yarn 52 extend over the opposite side of the drawcord 25. For example, as depicted in FIG. 4, the groups of connecting stitches 20*a*, 20*b* are connected between the edges 17*a*, 17*b* (FIGS. 2 and 3) proximate to the back sides 56 of the elastic webs 15*a*, 15*b* and extend across the back side 26 of the drawcord 25, and the groups of connecting stitches 20*c*, 20*d* are connected between the edges 17*a*, 17*b* proximate to the front sides 54 of the elastic webs 15*a*, 15*b* and extend across the front side 27 of the drawcord 25. The connector yarns 50, 52 do not penetrate the drawcord 25 and are not connected directly to the drawcord 25.

The tubes that feed the connector yarns 50, 52 (FIG. 7) that form the connecting stitch 20 are moved so that the connector yarns 50, 52 become held in place by the same crochet stitches that stitch filler yarns 35*a*, 35*b* to elastomers 30, and the drawcord 25 is attached to the composite elastic band 12 by virtue of the forming of the connecting stitch 20. Therefore, the elastic webs 15*a*, 15*b*, composite elastic band 12 and composite waistband 10 are formed contemporaneously.

As the knitting process is completed, the resultant composite elastic band 12 is released from tension and contracts to return to its relaxed length. Those skilled in the art will appreciate that this causes the drawcord 25 to form multiple protrusions 21, such as protruding loops or partial loops, on both sides of the composite elastic band 12 as shown in FIG. 4. The amount of drawcord 25 that is in the composite waistband 10 can be adjusted by adjusting the tension on the drawcord 25 as the drawcord 25 is fed into the knitting machine that forms the composite waistband 10. The drawcord 25 to elastic ratio can also be altered by limiting the size or number of the gathers or protrusions 21 by limiting the size or number of the "blank" spaces defined by the connecting stitch 20.

The frequency and duration at which the connector yarns 50, 52 (FIG. 7) that form the connecting stitch 20 are fed back and forth between the edges 17*a*, 17*b* can be varied to alter the number and/or the size of the "blanks" defined by the connecting stitch 20. For example, the number of oscillations or individual stitches in the groups of individual connecting stitches (e.g., groups of individual connecting stitches 20*a*, 20*b*, 20*c*, 20*d*) of the connecting stitch 20 can be increased so that each of the groups of individual connecting stitches extends farther longitudinally.

As an additional example, the back connector yarn 52 (FIG. 7) of the connector stitch 20 (or the back filler yarn 35*b* shown FIG. 6) can continually oscillate across the elongate space defined between the edges 17*a*, 17*b* (FIGS. 2–3 and 6–8) so that there are no "blank" spaces open toward the back sides 56 (FIG. 6) of the elastic webs 15*a*, 15*b*. In this embodiment, "blank" spaces defined by the connecting stitch 20 are open solely toward the front sides 54 of the elastic webs 15*a*, 15*b*; therefore, all of the protrusions 21 (FIGS. 3 and 4) protrude from proximate to the front sides 54 of the elastic webs 15*a*, 15*b*. In this embodiment, preferably the front connector yarn 50 (FIG. 7) is the LYCRA synthetic fiber and the back connector yarn 52 is polyester. It is also preferable for the back connector yarn 52 to oscillate between the elastomer 30 that is second from the edge 17*a* and the elastomer 30 that is second from the edge 17*b*. The back connector yarn 52 is connected to the back sides 56 of the elastic webs 15*a*, 15*b* by the same crochet stitches that stitch the filler yarns 35*a*, 35*b* to the elastomers 30 that are second from the edges 17*a*, 17*b* and the elastomers 30 that are located along the edges 17*a*, 17*b*.

After manufacture, the composite waistband 10 may be packaged as desired by the customer. For example, the composite waistband 10 may be festooned (i.e., layered back and forth in a container) or spooled. With reference to FIG. 1, the composite waistband 10 can be cut into lengths, formed into loops and incorporated into garments such as pants 11. An acceptable method for incorporating the composite waistband 10 into garments is disclosed in U.S. Pat. No. 5,375,266, the disclosure of which is incorporated herein by reference.

From the foregoing description, it will be appreciated that the present invention provides a high stretch composite elastic waistband 10 that is capable of having a high ratio of drawcord 25 to composite elastic band 12. Generally, this is accomplished by allowing the drawcord 25 to oscillate or form multiple protrusions 21, such as protruding loops or partial loops. In the preferred embodiment, this is accomplished by movably holding the drawcord 25 to two elastic webs 15*a*, 15*b* (which can be panels or ribbons) with a connecting stitch 20 that joins the elastic webs 15*a*, 15*b*. When the composite elastic band 12 relaxes, the drawcord 25 forms protrusions 21, such as loops or partial loops, on both sides of the composite elastic band 12. The protrusions 21 extend through spaces defined between groups of stitches of the connecting stitch 20.

Those skilled in the art will appreciate that the present invention provides an assortment of features and advantages. For example, the longer drawcord 25 makes it easier to stretch the product for placement on sewing equipment, thereby greatly reducing the repetitive stress on the operator's hands, wrists and elbows. In the event the drawcord 25 becomes pulled or snagged prior to being sewn into a garment, the drawcord 25 can be re-set its proper position by stretching and then releasing the composite elastic band 12. The drawcord 25 may be easily located and pulled from either side of the composite elastic band 12.

Figure 8:
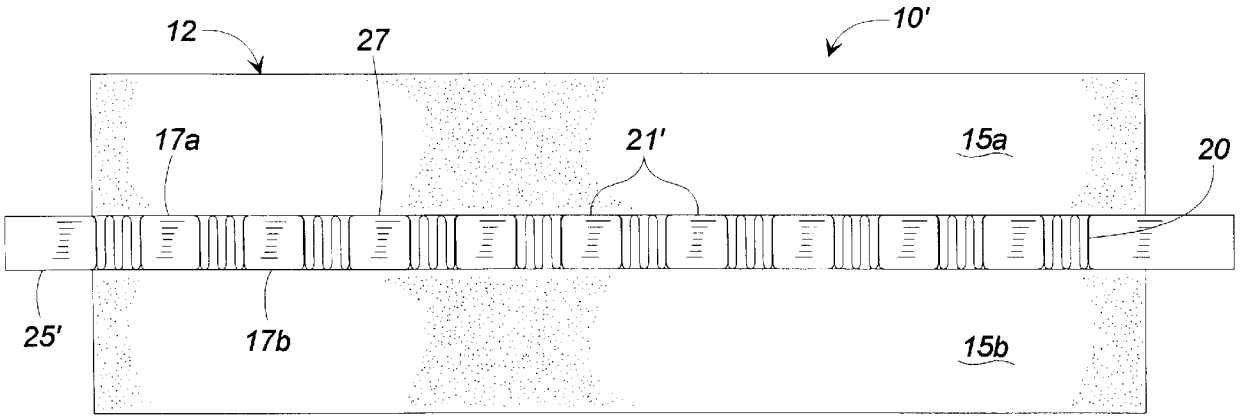
FIG. 8 illustrates the high stretch composite elastic waistband of a second exemplary embodiment of the present invention, wherein the composite elastic band is relaxed and has accumulated excess portions of the flat or tape-like drawcord.
Figure 9:
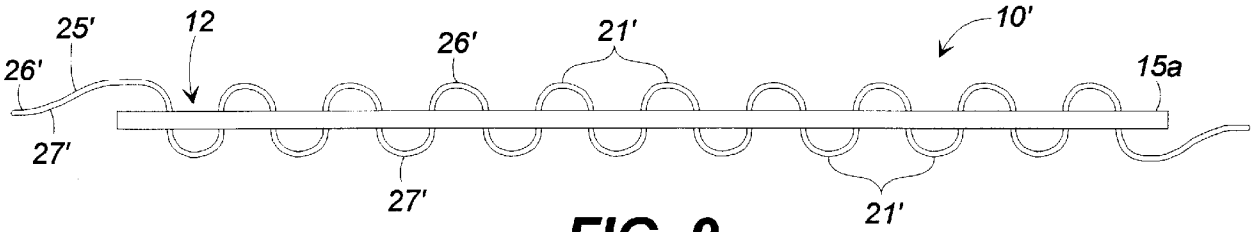
FIG. 9 is a top edge view of the high stretch composite elastic waistband of FIG. 8.
Figure 10:
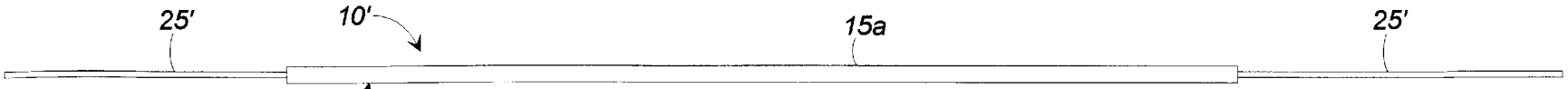
FIG. 10 is a top edge view of the high stretch composite elastic waistband of FIG. 8, wherein the excess portions of the drawcord have been drawn from the composite elastic band.

FIGS. 8–10 are schematic side and top views of a section of high stretch composite waistband 10' in accordance with a second exemplary embodiment of the present invention. Referring to FIGS. 1 and 3–5 for contrast, the drawcord 25 of the first exemplary embodiment is depicted in the form of a somewhat cylindrical cord; therefore, a cross-section of the drawcord 25 taken perpendicular to its length is somewhat circular. The composite waistband 10' of the second exemplary embodiment is generally identical to the composite waistband 10 of the first exemplary embodiment, except that the drawcord 25' of the second exemplary embodiment is flat or tape-like; therefore, a cross-section of the drawcord 25' taken perpendicular to its length is generally linear or flat. The drawcord 25' is preferably a ribbon of cloth that is generally not coaxially compressible or stretchable.

In FIGS. 8 and 9, the composite elastic band 12 is relaxed and accumulating excess portions of the drawcord 25'. In FIG. 10, the composite elastic band 12 is relaxed and excess portions of the drawcord 25' have been drawn from the composite elastic band 12. The connecting stitch 20 is not seen in FIGS. 9 and 10 because the thin drawcord 25' does not have as much of a tendency as the thicker drawcord 25 (FIGS. 1 and 3–5) to push stitches of the connecting stitch 20 to the side of the composite elastic band 12.

The composite waistband 10' of the second exemplary embodiment functions generally identically to the composite waistband 10 of the first exemplary embodiment (FIGS. 1 and 3–5). When the composite waistband 10' is configured as depicted in FIGS. 8 and 9, the ends of the drawcord 25' can be grasped and pulled to release portions of the drawcord 25' from the composite elastic band 12. When the portions of the drawcord 25' are drawn from the composite elastic band 12, the gathers or protrusions 21' (only a select few of which are specifically pointed out in FIGS. 8 and 9) of the drawcord 25' are flattened such that they are no longer defined, as depicted in FIG. 10. Then, the composite elastic band 12 can be stretched longitudinally and released to cause the gathers or protrusions 21' to automatically reform, as should be understood by those skilled in the art in light of this disclosure.

The present invention has been described in relation to particular embodiments which are intended in all respects to be illustrative rather than restrictive. Although the present invention has been described in the context of a composite waistband 10 in which the drawcord 25 is held by a connecting stitch 20 that joins two elastic webs 15*a*, 15*b*, those skilled in the art will understand that the principles of the present invention may be applied to other configurations. For example, the composite waistband may be constructed from a single elastic web and the drawcord may be laced back and forth through holes or openings in the elastic web that are arranged to allow the drawcord to form multiple protrusions, such as protruding loops or partial loops, on both sides of the elastic webs as the elastic returns to a relaxed state.

Those skilled in the art will appreciate that the ratio of drawcord to elastic web may be reduced to some degree by limiting or eliminating the amount of protruding or looping that takes place on one side of the elastic web. For example, the drawcord can be movably attached proximate to the side of an elastic web, band or the like, by attaching spaced groups of stitches to the side of the web to define a "tunnel" within which the drawcord movably resides. The spaced groups of stitches are arranged to define a series of openings to the tunnel or "blanks" along the longitudinal length of the tunnel. Portions of the drawcord can selectively protrude through those openings to accumulate and release portions of the drawcord in a manner analogous to that described above, as should be understood by those skilled in the art.

As another example, the connecting stitch can be defined by a single yarn that oscillates between and joins the elastic webs 15*a*, 15*b*, and the drawcord may be laced back and forth through that connecting stitch to allow the drawcord to form multiple protrusions, such as protruding loops or partial loops, on one or both sides of the elastic web as the elastic returns to a relaxed state.

The present invention has been described in relation to particular embodiments which are intended in all respects to be illustrative rather than restrictive. Alternative embodiments will become apparent to those skilled in the art without departing from the spirit and scope of the present invention. Accordingly, the scope of the present invention is defined by the appended claims.

What is claimed is:

1. A composite band, comprising:

an elongate elastic web defining a longitudinal direction; and a drawcord movably connected to the elastic web and extending generally in the longitudinal direction, wherein the drawcord defines a plurality of gathers, and the composite band is constructed so that:

at least a section of the drawcord is capable of being pulled away from the elastic web so that gathers of the plurality of gathers are diminished, and the elastic web is capable of being stretched longitudinally and released so that as the elastic web contracts, the elastic web cooperates with the drawcord to cause the drawcord to move relative to the elastic web and define the plurality of gathers.

2. The composite band of claim 1, wherein the elastic web defines a plane, and the plurality of gathers extend generally perpendicularly relative to the plane.

3. The composite band of claim 1, wherein the plurality of gathers defines a plurality of at least partial loops.

4. The composite band of claim 1, wherein the plurality of gathers defines a longitudinally extending pattern that extends along the length of the elastic web.

5. The composite band of claim 1, wherein the composite band defines a first side and a second side, wherein the plurality of gathers is a first plurality of protrusions that protrude from the first side of the composite band, wherein the drawcord further defines a second plurality of protrusions that protrude from the second side of the composite band, and wherein the composite band is constructed so that:

at least a section of the drawcord is capable of being pulled away from the elastic web so that protrusions of the first plurality of protrusions and the second plurality of protrusions are at least partially flattened, and the elastic web is capable of being stretched longitudinally and released so that the elastic web contracts and cooperates with the drawcord to define the first plurality of protrusions and the second plurality of protrusions.

6. The article of manufacture of claim 1, further comprising a garment having a perimeter defining an opening, wherein the composite band is formed into a loop and connected to the perimeter.

7. The composite band of claim 1, wherein the drawcord is flat.

8. The composite band of claim 1, further comprising a plurality of members movably connecting the drawcord to the elastic web, wherein gathers of the plurality of gathers protrude between at least some members of the plurality of members.

9. The composite band of claim 8, wherein the plurality of members comprises stitches.

10. The composite band of claim 9, wherein the drawcord comprises a first side and a second side, and a first segment and a second segment contiguous with the first segment, wherein the first side of the first segment faces a first plurality of the stitches, and at least a portion of the second side of the first segment protrudes away from and is displaced from the stitches, and wherein the second side of the second segment faces a second plurality of the stitches, and at least a portion of the first side of the second segment protrudes away from and is displaced from the stitches.

11. The composite band of claim 1, wherein the composite band defines a plurality of openings through which the plurality of gathers protrude.

12. The composite band of claim 1, further comprising a plurality of stitches connecting the drawcord to the elastic web, wherein the plurality of stitches define the plurality of openings through which the plurality of gathers protrude.

13. A composite band, comprising:

a longitudinally extending elastic web;

a drawcord; and a plurality of connector members movably connecting the drawcord to the elastic web so that the drawcord extends in the longitudinal direction, wherein a space is defined between neighboring connector members of the plurality of connector members so that a plurality of spaces is defined, the drawcord defining a plurality of protrusions extending at least partially through at least some spaces of the plurality of spaces.

14. The composite band of claim 13, wherein the connector members comprise yarn.

15. The article of manufacture of claim 13, further comprising a garment having a perimeter defining an opening, wherein the composite band is formed into a loop and connected to the perimeter.

16. The composite band of claim 13, wherein the composite band is constructed so that at least a section of the drawcord is capable of being pulled away from the elastic web so that protrusions of the plurality of protrusions are at least partially flattened, and the elastic web is capable of being stretched longitudinally and released so that the elastic web contracts and cooperates with the drawcord to cause the drawcord to define the plurality of protrusions.

17. The composite band of claim 16, wherein the elastic web is a first elastic web comprising a first longitudinally extending edge, wherein the composite band further comprises a second elongate elastic web that is parallel to the first elastic web and comprises a second longitudinally extending edge, wherein the first edge is proximate to the second edge and an elongate space is defined between the first edge and the second edge, wherein the plurality of connector members comprises a plurality of stitches extending across the elongate space and connecting the first elastic web to the second elastic web, and wherein the first elastic web and the second elastic web cooperate to define a broad surface that defines a plane, and the plurality of protrusions extend generally perpendicularly relative to the plane.

18. A composite band, comprising:

an elongate first elastic web defining a longitudinal direction and comprising a first longitudinally extending edge;

an elongate second elastic web that is parallel to the first elastic web and comprises a second longitudinally extending edge, wherein the first edge is proximate to the second edge and an elongate space is defined between the first edge and the second edge;

a plurality of stitches connecting the first elastic web to the second elastic web; and a drawcord movably connected to the elastic webs by the plurality of stitches, wherein the drawcord extends generally in the longitudinal direction, wherein the drawcord is at least partially disposed in the elongate space, wherein the drawcord defines a plurality of protrusions that protrude from the elongate space between at least some of the stitches of the plurality of stitches, and wherein the composite band is constructed so that:

at least a section of the drawcord is capable of being pulled away from the elongate space so that protrusions of the plurality of protrusions are at least partially flattened, and the elastic webs are capable of being stretched longitudinally and released so that the elastic webs contract and cooperate with the drawcord to cause the drawcord to define the plurality of protrusions.

19. A method, comprising the steps of:

connecting a longitudinally extending drawcord to a longitudinally extending elastic web that is elastic in the longitudinal direction; and releasing the elastic web from longitudinal tension, wherein the drawcord is connected to the elastic web so that in response to the releasing step, the elastic web contracts and causes the drawcord to move relative to the elastic web so that the drawcord defines a plurality of gathers.

20. The method of claim 19, further comprising the steps of:

pulling the drawcord away from the elastic web so that gathers of the plurality of gathers are diminished; and subsequent to the pulling step, stretching the elastic web longitudinally and then releasing the elastic web so that the elastic web contracts and causes the drawcord to move relative to the elastic web to define the plurality of gathers.

* * * * *